United States Patent [19]

Sauerbrey

[11] Patent Number: 5,005,828

[45] Date of Patent: Apr. 9, 1991

[54] HIGH JUMP RIBBON ASSEMBLY

[76] Inventor: Roland Sauerbrey, 94 Bruehlstrasse, in 9320 Arbon, Kanton Thurgau, Switzerland

[21] Appl. No.: 546,718

[22] Filed: Jul. 2, 1990

[51] Int. Cl.[5] ..... A63B 5/02

[52] U.S. Cl. ..... 272/103; 446/901

[58] Field of Search ..... 272/101, 102, 103, DIG. 4, 272/DIG. 5

[56] References Cited

U.S. PATENT DOCUMENTS

| | | | |
|---|---|---|---|
| 1,907,149 | 5/1933 | Austin | 272/103 |
| 2,299,798 | 10/1942 | Colson et al. | 272/102 |
| 2,827,116 | 3/1958 | Zialovcik | 272/103 |
| 3,450,405 | 6/1969 | Mates | 446/901 |
| 3,497,212 | 2/1970 | Gotcher | 272/103 |

FOREIGN PATENT DOCUMENTS

| | | | |
|---|---|---|---|
| 0803943 | 2/1981 | U.S.S.R. | 272/102 |
| 2059784 | 4/1981 | United Kingdom | 272/102 |

*Primary Examiner*—Robert Bahr
*Assistant Examiner*—L. Thomas
*Attorney, Agent, or Firm*—Howard J. Greenwald

[57] ABSTRACT

A high jump ribbon assembly is disclosed which contains a fabric ribbon and at least two brackets, each of which is adapted to be attached to a standard. The fabric ribbon contains a base material and at least two portions of fibrous fastener fabric attached to it. The brackets each have attached to them two separate pieces of complementary fibrous fastener fabric.

20 Claims, 4 Drawing Sheets

HIGH JUMP RIBBON ASSEMBLY

FIELD OF THE INVENTION

A high jump ribbon assembly which contains a fabric ribbon, and least two brackets, means for adjustably attaching the brackets to high jump standards, and means for removably attaching the high jump ribbon to the brackets.

BACKGROUND OF THE INVENTION

Devices designed to present an obstacle over which an athlete must jump are well known. Thus, for example, U.S. Pat. No. 932,142 of Kimmel describes a leaper's obstacle which contains a hollow bar of flexible and air-tight material, means attached thereto to permit inflation with air, and means for attaching the bar to a support. U.S. Pat. No. 1,907,149 of Austin discloses a hurdle containing a set of curved standards and a hurdle bar. U.S. Pat. No. 1,928,280 of Barron describes an adjustable base for pole vaulting standards; Barron's device includes a base, upright members mounted therein and carrying horizontal guide rods, and an upright standard horizontally movable along such guide rods. U.S. Pat. No. 2,236,935 of Cameron describes a vaulting standard comprised of a base, a horizontally adjustable carriage on the base, and a horizontal bar supporting upright on the carriage. U.S. Pat. No. 3,222,064 of Langston discloses an automatic pole vault standard in which a horizontal bar is cantilevered from each of the uprights and spring-biased and pneumatically throttled to return to a standard position after contact by a participant. U.S. Pat. No. 3,497,212 of Gotcher discloses a diving hurdle comprised of a pair of standards, base means for supporting the standards on the deck of a pool, and a rope.

The prior art high jump assemblies present a substantial risk of injury to the athlete. With those high jump assemblies which utilize horizontal rods of aluminum or fiberglass material, there is a risk that the detached rods might fall onto the back of the jumper.

Some of the prior art devices utilize a high jump ribbon, such as a rubber cord, whose ends are retained under tension on the high jump stands by means of a tongue slide. The tongue slide permits the rubber cord to slide out of it when the cord is hit by the jumper. Unfortunately, in many cases, the quick rebound of the tensioned rubber cord causes injury to the jumper. Furthermore, if the rubber cord is not caused to release from the tongue slide(s) by the jumper's impact, pulsations may be created in the rubber cord which may cause the high jump stands to fall.

Some high jump assemblies contain a rope which is tensioned between the high jump stands by weights (such as small sandbags) at each end. In many instances, the impact of the jumper on the rope does not cause the rope to drop but rather pulled the high jump stands towards the center of the rope, causing the stands to fall onto the jumper.

It is an object of this invention to provide a high jump assembly comprised of a high jump ribbon in which the risk of injury to the jumper upon impact of the high jump ribbon is greatly reduced.

It is another object of this invention to provide a high jump assembly whose height can be readily adjusted.

It is yet another object of this invention to provide a high jump assembly which contains electronic means for measuring the height of a jump.

It is yet another object of this invention to provide a high jump assembly which contains means for leveling the electronic measuring means described above.

SUMMARY OF THE INVENTION

In accordance with this invention, there is provided a high jump ribbon assembly which contains a fabric ribbon, and least two brackets, means for adjustably attaching the brackets to high jump standards, and means for removably attaching the high jump ribbon to the brackets.

BRIEF DESCRIPTION OF THE DRAWINGS

The present invention will be more fully understood by reference to the following detailed description thereof, when read in conjuction with the attached drawings, wherein like reference numerals refer to like elements, and wherein.

DESCRIPTION OF THE PREFERRED EMBODIMENTS

Figure 1:
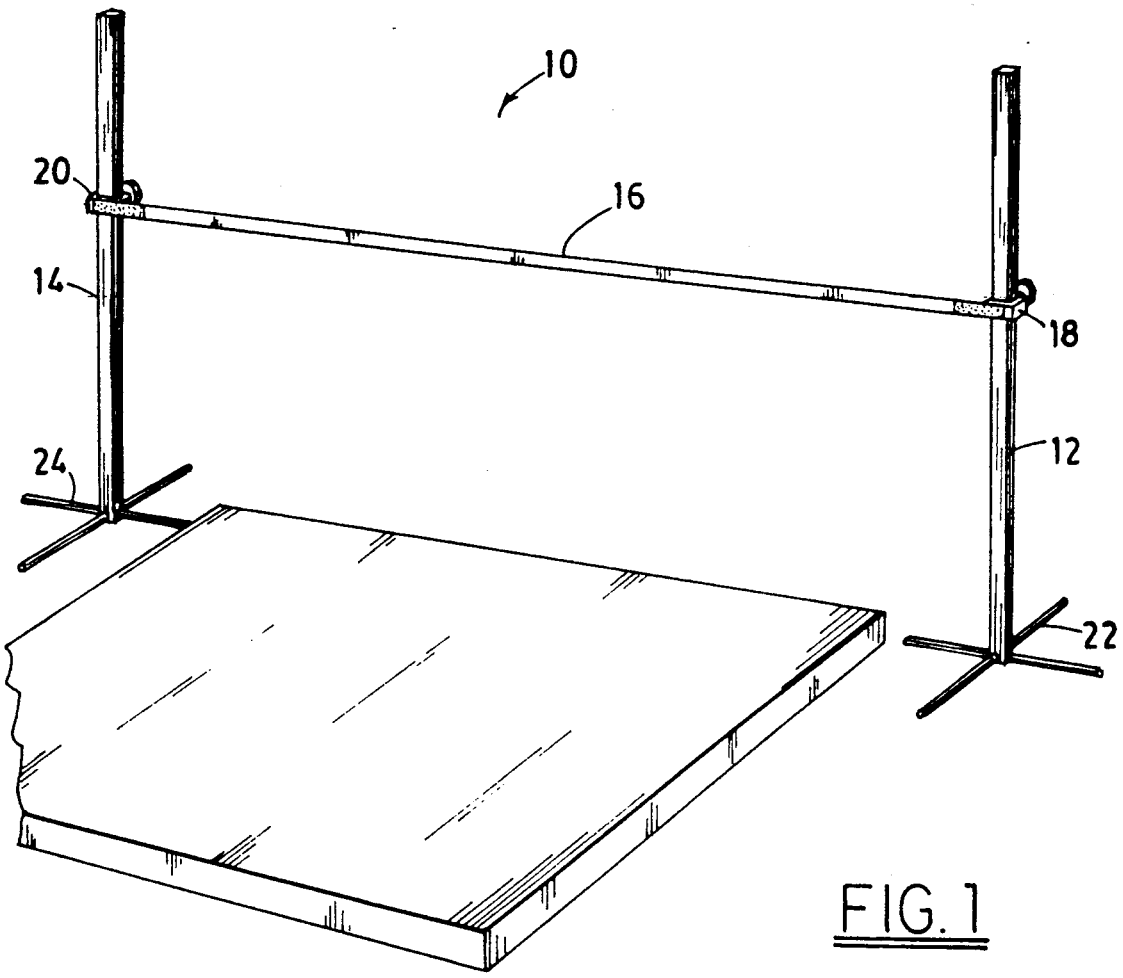
FIG. 1 is a perspective view of a hurdle comprised of one preferred embodiment of the high jump assembly of this invention.

One preferred embodiment of applicant's invention is illustrated in FIG. 1. Referring to FIG. 1, high jump assembly 10 is comprised of standards 12 and 14, high jump ribbon 16, adjustable bracket 18, and adjustable bracket 20.

Any of the high jump standards known to those skilled in the art may be used as standards 12 and 14. Thus, as is disclosed in U.S. Pat. No. 1,928,280, either or both of said upright supports may comprise a base and upright members mounted therein and carrying horizontal guide rods. Thus, either or both of the standards may have a rectangular, rectilinear, or square cross-section, as is illustrated in U.S. Pat. No. 2,299,798. Thus, as is disclosed in U.S. Pat. No. 2,236,935, either or both of the standards may comprise a base, a horizontally adjustable carriage on the base and a horizontal bar supporting upright on the carriage. The standard(s) may contain an upright, a horizontal member supported by said upright comprising an arm, disc means on said arm, tangs extending from said disc means, a piston rod and piston pivotally attached to said disc means, a cylinder having slots normally receiving said tangs, and a cylinder opening; see U.S. Pat. No. 3,222,064. Thus, as is disclosed in U.S. Pat. No. 3,497,212, either or both of the standards may be supported by a base, such as a concrete block. Thus, as is disclosed in U.S. Pat. No. 3,637,204, either or both of the standards may comprise a crossbar-supporting peg thereon, electrical means connected to the standards for detecting if the crossbar is on the pegs, and means connected to the standards for automatically lowering the pegs in response to the detection that the crossbar is not on the pegs.

In the preferred embodiment illustrated in FIG. 1, high jump standards 12 and 14 are mounted on bases 22 and 24; and each of these standards are substantially identical to each other.

Figure 2:
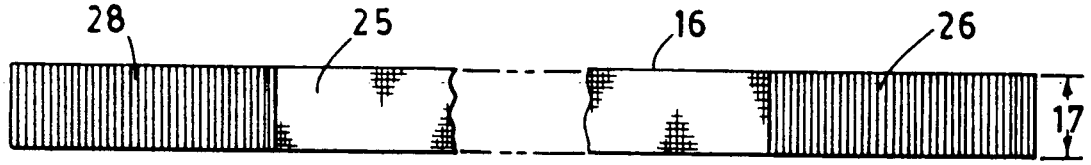
FIG. 2 is a top view of a preferred embodiment of the high jump ribbon of this invention.

Referring again to FIG. 1, high jump ribbon 16 is disposed between standard 12 and standard 14. As used herein, the term ribbon refers to a narrow strip of fabric. This high jump ribbon is preferably a fabric material whose ends are comprised of "VELCRO," synthetic materials which adhere together. Thus, referring to FIGS. 2 and 3, portions 26 and 28 of ribbon 16 comprise said "VELCRO" material attached to fabric material. The "VELCRO" material may be attached to the fabric material by being sewn thereto, glued thereto, and the like.

Processes for preparing "VELCRO" are well known to those skilled in the art. The "VELCRO" fastening system is comprised of at least one material containing fabric hooks comprised of synthetic resin and, on a mating surface, at least one material comprised of complementary fabric pile comprised of synthetic resin. One such process for making these types of material is described in U.S. Pat. No. 2,717,437 of deMestral, which discloses a method for producing a velvet type of fabric; the disclosure of this patent is hereby incorporated by reference into this specification. In this process, there is weaved together a plurality of weft threads and a plurality of warp threads of synthetic resin material (such as nylon), thereby forming loops with said auxiliary warp threads on one surface of the so woven fabric. The loops so formed are subjected to a thermal source, thereby causing the loops to retain their shape and to form raised pile threads. The loops may then cut near their outer ends, thereby forming material-engaging means on at least a portion of the pile threads constituted by the cut loops.

The "VELCRO" material which appears on bracket 18 or bracket 20 is complementary to the "VELCRO" material appearing on ribbon 16. If the former is a loop material, the latter is a hook material. Conversely, if the latter is a loop material, the former is a hook material. In one preferred embodiment, "VELCRO" loop material is used on the ribbon 16, and complementary "VELCRO" hook material is used on the bracket.

Figure 3:
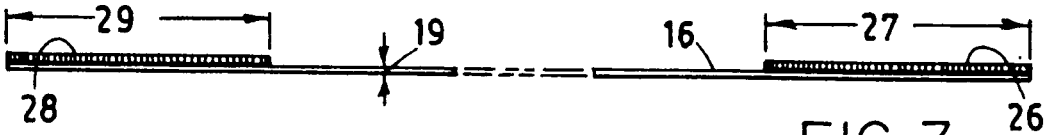
FIG. 3 is a side view of a preferred embodiment of the high jump ribbon of this invention.

It is preferred to attach a portion of complementary "VELCRO" material to each of the ends of ribbon 16 so that, in the end portions of the ribbon thus produced, substantially two layers of fabric appear (see FIG. 3). Referring to FIG. 3, the "VELCRO" material will appear on a portion 26 of one end of the ribbon 16 and a portion 28 of the other end of ribbon 16. The length 27 of portion 26 may be, but need not be, substantially identical to the length 29 of portion 28.

It is preferred that each of "VELCRO" portions 26 and 28 be from about 2 to about 7 inches in length and, more preferably, from about 3 to about 6 inches in length. Portions 26 and 28 may have the same length, or their lengths may differ.

It is preferred that each of "VELCRO" portions 26 and 28 have a width 17 which is substantially identical to the width of ribbon 16. In general, the width of portions 26 and 28 is from about 1 to about 3 centimeters. It is preferred that the width of portions 26 and 28 be from about 1.5 to about 2.5 centimeters. It is even more preferred that the width of portions 26 and 28 be from about 2 centimeters. The widths of these portions may be identical or dissimilar.

At least about 50 weight percent of ribbon 16 is comprised of textile material. It is preferred that at least about 60 weight percent of ribbon 16 is comprised of textile material. It is even more preferred that at least about 70 weight percent of ribbon 16 is comprised of textile material.

As is well known to those skilled in the art, a textile is a material made of natural or man-made fibers and used for the manufacture of items such as clothing, household furniture, and automobile fittings. The raw materials are fibers made of materials such as cotton, wool, other cellulosic materials, nylon, acrylic resin, glass, or even metal. See, e.g., pages 547–559 of Volume 13 of the McGraw-Hill Encyclopedia of Science and Technology (McGraw-Hill Book Company, New York, 1977), the disclosure of which is hereby incorporated by reference into this specification. Thus, e.g., the "VELCRO" material described above may be a textile material.

Ribbon 16 is preferably comprised of at least two different textile materials. One of such materials is the "VELCRO" hook or loop material which appears at the ends of ribbon 16. The other of such materials is the textile base 25 material to which the "VELCRO" material is attached.

The textile base material 25 may comprise or consist of any natural or synthetic fiber, as long as ribbon 16 has the required tensile properties. Thus, for example, it might consist essentially of a man-made fiber selected from the group consisting of rayon, nylon, regenerated cellulose, cellulose acetate, cellulose diacetate, cellulose triacetate, polyester, polyacrylic, polyvinyl, and polyolefin fibers; these and other man-made fibers are described on pages 263–267 of Volume 5 of the McGraw-Hill Encyclopedia of Science and Technology (McGraw-Hill Book Company, New York, 1977), the disclosure of which is hereby incorporated by reference into this specification. Thus, e.g., the textile base material 25 may consist essentially of natural fiber such as, e.g., cotton, wool, and the like; such natural fibers are described on pages 267–276 of Volume 5 of said McGraw-Hill Encyclopedia of Science and Technology, supra. Mixtures of such fibers also may be used.

In one preferred embodiment, the base material of ribbon 16 (not including the VELCRO) is comprised of at least 50 weight percent of cotton.

In another preferred embodiment, the base material of ribbon 16 is comprised of at least about 50 weight percent of nylon and, more preferably, at least about 60 weight percent of nylon. In one aspect of this embodiment, the ribbon consists essentially of nylon.

As is known to those skilled in the art, the term nylon is a generic term for any lon-chain synthetic polyamide used for fibers and plastics. One of the more important polyamides is nylon 66, which is made from hexamethylene diamine and adipic acid. Another important nylon is nylon 6, which is made by the condensation of caprolactam molecules.

In one preferred embodiment, ribbon 16 consist essentially of a VELCRO and nylon base material. In this preferred embodiment, the nylon base material has a reversible elasticity of less than about 4 percent and, more preferably, from about 2 to about 4.0 percent; in one especially preferred embodiment, the reversible elasticity of the nylon base material is from about 2.5 to about 3.5 percent. Thus, in this preferred embodiment, when the base material is stretched just short of its breaking point, its length will preferably from about 1.02 to about 1.04 times as great as its unstretched length. Furthermore, when the tension on the material is relaxed, the material, because of its elastic properties, returns to a length of from about 0.98 to about 1.02 times its original length. Means for measuring these physical properties as well known to those skilled in the art such as the means disclosed, e.g., in: (1) J. E. Booth, "Principles of Textile Testing," Third Edition (Chemical Publishing Company, Inc., New York, 1969), at pages 353–456; (2) E. B. Grover et al., "Handbook of Tensile Testing and Quality Control" (Textile Book Publishers, Inc., New York, 1960), and (3) R. Meredith et al., "Physical Methods of Investigating Textiles" (Textile Book Publishers, Inc., New York, 1959). The disclosure of each of these publications is hereby incorporated by reference into this specification.

It is preferred to determine the tensile properties of the ribbon 16 in accordance with the procedure described in A.S.T.M. Standard Test D 1682–64 (Reapproved 1975, "Standard Test Methods for Breaking Load and Elongation of Textile Fabrics" (American Society for Testing and Materials, Philadelphia, Pennsylvania).

Ribbon 16 preferably has a width 17 (see FIG. 2) of from about 1 to about 3 centimeters. It is preferred that the width 17 of ribbon 16 be from about 1.5 to about 2.5 centimeters. It is even more preferred that the width 17 of ribbon 16 be about 2 centimeters.

Ribbon 16 preferably has a thickness 19 (see FIG. 3) of from about 0.1 to about 2.0 millimeters and, preferably, from about 0.3 to about 1.0 millimeters. In a more preferred embodiment, thickness 19 is from about 0.4 to about 0.6 millimeters. In an even more preferred embodiment, thickness 19 is about 0.5 millimeters.

The high jump assembly of this invention is also comprised of bracket 18, which also contains "VELCRO" material.

Any of the prior art brackets which comprise means for adjustably attaching the bracket to a standard may be used in applicant's device, as long as it preferably contains some "VELCRO" material on one of its surfaces.

By way of illustration, one may use a vertically adjustable bracket adapted to be held by screw clamps at different predetermined heights on the standards; such brackets are shown in U.S. Pat. No. 2,299,798, the disclosure of which is hereby incorporated by reference into this specification. One of the brackets disclosed in this patent is associated with a series of light sources spaced equally within a casing at predetermined distances above the top of the high jump bar (such as intervals of one inch). The other bracket disclosed in this patent provides a control cabinet on the inside of which are exposed a number of light-sensitive indicating devices, such as photoelectric cells, spaced equally above the bar at intervals exactly coinciding with the intervals between the light source.

Figure 4:
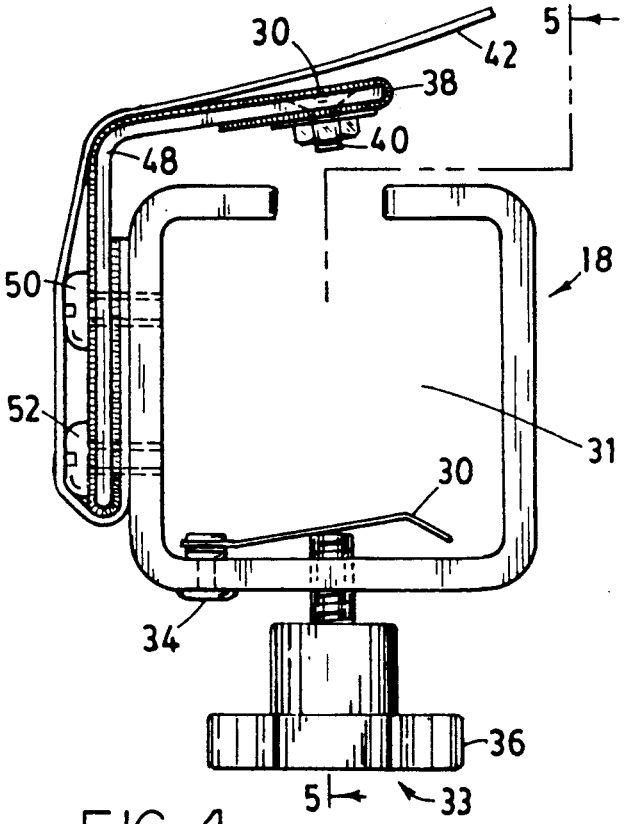
FIG. 4 is a top view of one preferred embodiment of a bracket used in the preferred embodiment of the invention.

Referring to FIG. 4, bracket 18 is comprised of an orifice 31 adapted to receive standard 12, a means 33 for removably attaching the bracket to the standard, and "VELCRO" closure material.

It is preferred that orifice 31 have substantially the same shape as the standard which it is adapted to receive, although it is not essential that such geometries be identical. Thus, for example, in the embodiments illustrated in FIG. 6, brackets 18 and 20 have a substantially rectangular cross-sectional shape, and standards 12 and 14 have a substantially square cross-sectional shape.

Each of brackets 18 and 20 preferably comprise a means 33 for removably attaching the bracket to the standard. Any suitable means 33 may be used to attach the bracket to the standard. Thus, for example, one may use a handwheel clamp screw, or a camlever action.

Figure 5:
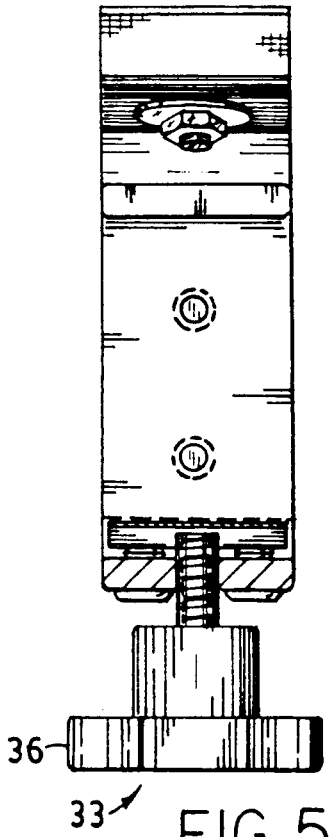
FIG. 5 is a sectional view of the bracket of FIG. 4, taken along lines 5—5.
Figure 6:
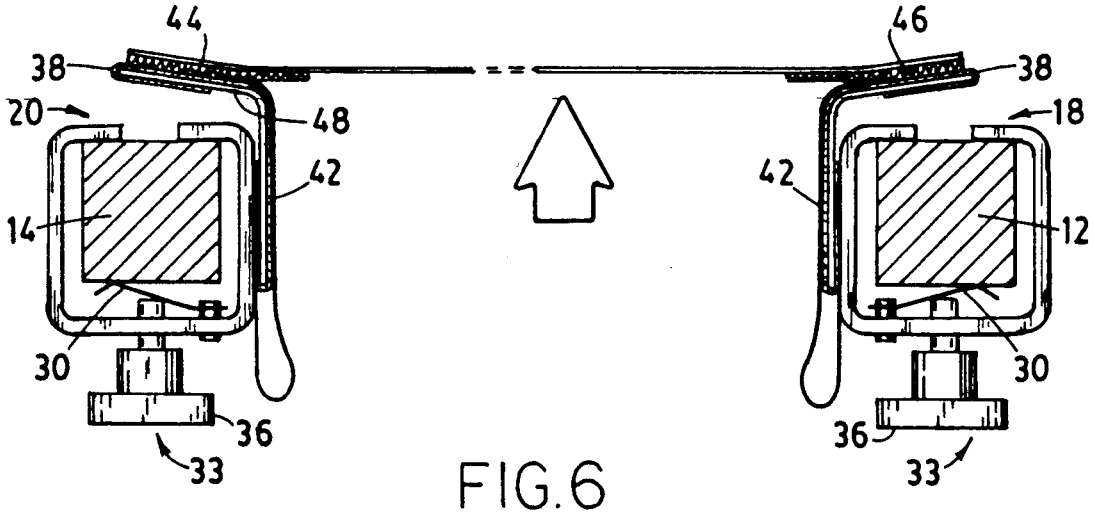
FIG. 6 illustrates how the preferred high jump ribbon of this invention is used in conjunction with two of the preferred brackets of the invention to provide the embodiment of the invention illustrated in FIG. 1.

In the preferred embodiment illustrated in FIGS. 4, 5, and 6, means 33 is comprised of a spring-steel pressure plate 30 connected to the internal surface of the bracket by fastening means 34 and clampscrew 36. The use of the spring-steel pressure plate 30 distributes the point load of the clampscrew 36 and tends to prevent indentations from forming on the standards 12 and 14. Brackets 18 and 20, which preferably are a substantially U-shaped device which consists of a rigid rectangular steel frame, is preferably formed in a suitable manner to slide-fit on the standards 12 and 14 and can be locked thereon at any desired height by means of clampscrew 36.

In another embodiment, not shown, pressure plate 30 is spring-loaded and is comprised of at least to springs operatively connected to the plate 30. Although the mechanism of the spring-loaded plate 30 differs from that of the spring-steel pressure plate, it serves substantially the same function of evenly distributing the pressure from clampscrew 36.

In the preferred embodiment of the bracket illustrated in FIG. 4, two complementary "VELCRO" materials are attached to the bracket. The first "VELCRO" material 38 is secured to clamp 20 by conventional means such as, e.g., the screw 40. The second "VELCRO" material 42 is complementary to material 38; if the latter material is loop material, the former material is hook material.

"VELCRO" material 42 can be placed so that it adheres to covers part of interior "VELCRO" material 38. Thus, referring to FIG. 6, material 42 is removably attached at points 44 and 46 on brackets 20 and 18, respectively. The "VELCRO" material on ribbon 16 is free to mesh with and adhere to the "VELCRO" material on brackets 18 and 20 only on those portions of the bracket where the material 42 is not covering the material 38. Thus, by varying the extent of the surfaces of material 42 which engage the surface of material 38, the amount of tear force required to disengage ribbon 16 from brackets 18 and 20 may be varied.

In one embodiment, not shown, the degree of engagement between the "VELCRO" surface on ribbon 16 and the "VELCRO" surface on bracket 18 is different from the degree of engagement between the "VELCRO" surface on ribbon 16 and the "VELCRO" surface on bracket 20. Thus, when ribbon 16 is subjected to force by being contacted with the body of a jumper, one side of the ribbon will often preferably disengage from the bracket.

Referring again to FIG. 4, bracket 18 is comprised of keeper 48, which is attached to the main body of the bracket by screws 50 and 52; the "VELCRO" materials 38 and 42 are attached to said keeper by said screws. In another embodiment, not shown, the bracket 18 does not comprise said keeper, and the "VELCRO" material 38 and 42 are attached directly to one of the surfaces of bracket 18.

Figure 8:
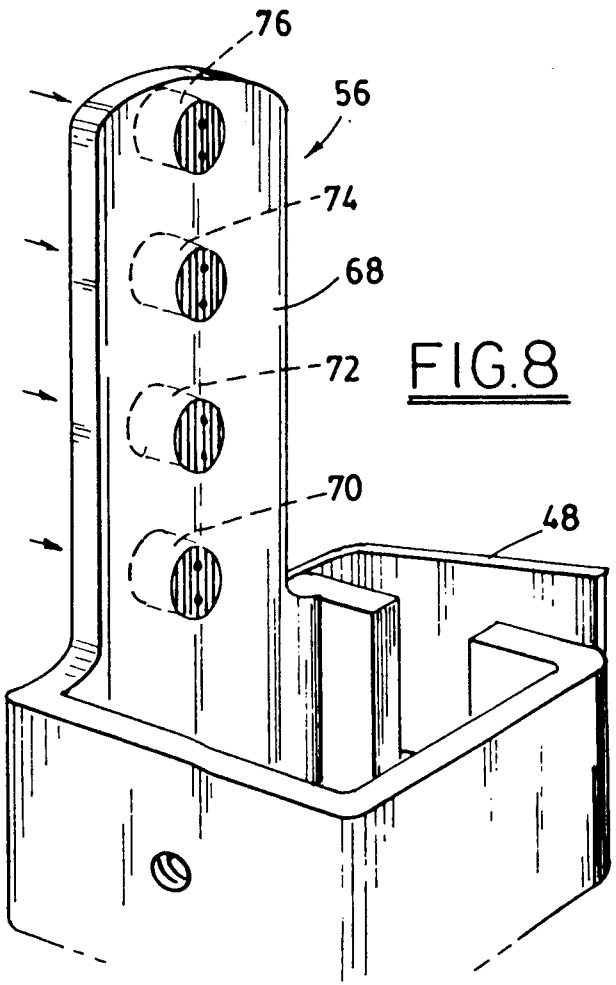
FIG. 8 is a perspective view of a bracket used in conjunction with the bracket of FIG. 7.

In another embodiment of the invention, a bracket is used which facilitates the electronic determination of the height the athlete jumps over the ribbon 16. This embodiment, which is illustrated in FIGS. 7 and 8, is shown for the sake of simplicity without the "VELCRO" surfaces 38 and/or 42 and without the attachment means used to attach the keeper 48 to the brackets.

Figure 7:
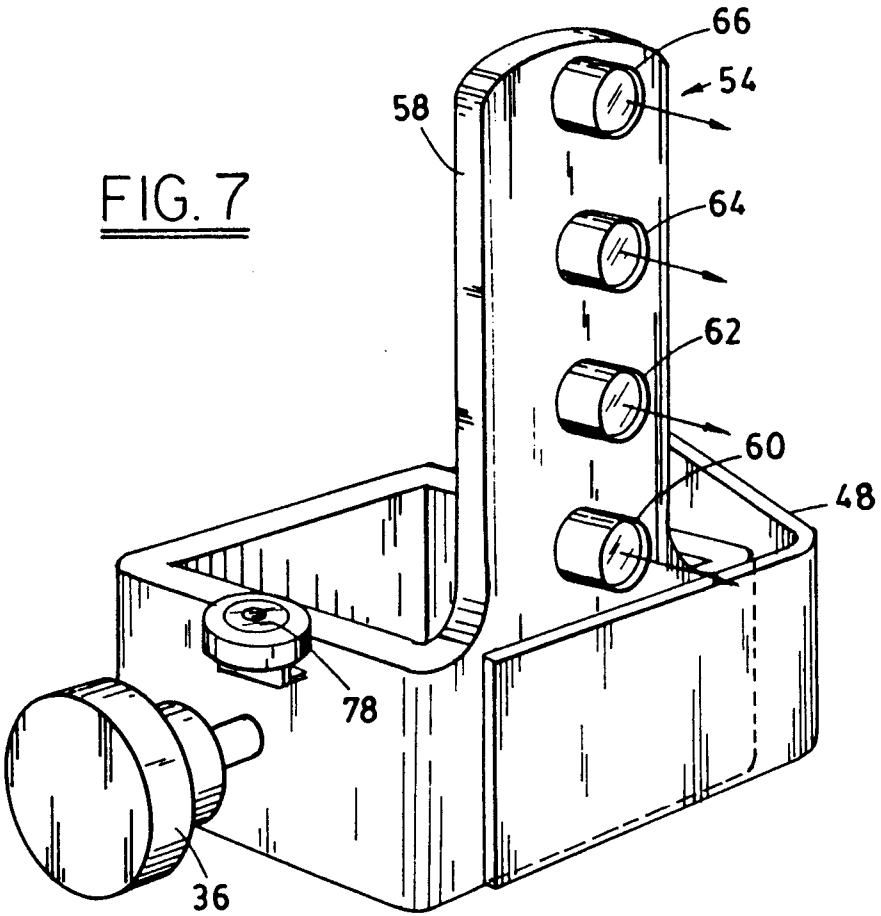
FIG. 7 is a perspective view of another bracket used in a preferred embodiment of the invention, which bracket is equipped with a spirit level and light-emitting means.

Referring to FIGS. 7 and 18, brackets 54 and 56 comprise keepers 48. "VELCRO" materials 38 and 42 may be attached to these keepers 48 by means such as screws 40, 50, and 52 (see FIG. 4).

Each of brackets 54 and 56 also comprise means 33 for adjustably attaching the bracket to a standard, such as clampscrew 36. For the sake of simplicity, only one such means is shown in FIG. 7, it being understood that any such suitable means is supplied with the bracket of FIG. 8.

Bracket 54 is comprised of projection 58 which contains at least one source of light 60. It is preferred that projection 58 comprise a multiplicity of light sources, such as light sources 62, 64, and 66. In one preferred embodiment, shown in the FIG. 8, four light sources are used.

Light sources 60, 62, 64, and 66 may be any commercially available sources of light. Thus, e.g., one may use any source of light which will focus the light into a relatively narrow beam, such as, e.g., a point source lamp. As is known to those skilled in the art, a point source lamp is a lamp, which is usually incandescent, that has a very compact filament, permitting a greater concentration of emitted light, aided by the use of small apertures and appropriate reflectors.

It is preferred that the distances between adjacent light sources 60, 62, 64, and 66 be substantially equal. In one embodiment, the distance between each such adjacent light source is from about 0.5 to about 2.0 inches and, preferably, is about 1.0 inch.

In a preferred aspect of applicant's invention, brackets 54 and 56 will be mounted at substantially the same height. Light rays emanating from bracket 58 will be sensed by optical sensors on projection 68. This sensing will continue as long as the path of the light beam(s) is not broken. If, however, an athlete jumps over ribbon 16 (not shown) and intersects the path of one or more of said light beams, the corresponding lights sensor on bracket 56 will cease to sense the light beams and this fact will be noted on a calibrated monitor (not shown). In this embodiment, the light beam whose path is not broken will indicate the height of the jump. If, for example, the path of light beams from lamps 62 and 64 is broken by the jumper's body but not that of the light beam from lamp 60, it will be noted that the jumper cleared the height at which lamp 60 was at but not the height at which lamp 62 was at.

Any of the optical sensors known to those skilled in the art may be used in bracket 56 as sensors 70, 72, 74, and 76. Thus, by way of illustration, one may use the optical sensors described on pages 574–576 of the "McGraw-Hill Encyclopedia of Electronics and Computers" (McGraw-Hill Book Company, New York, 1984), the disclosure of which is hereby incorporated by reference into this specification.

In one embodiment, not shown, a combination of a point light source and an optical receptor is placed in front of the jump assembly. When the athlete approaches the assembly in order to jump, he breaks the path of the light between these devices, thereby automatically triggering a television camera having a graduated lens which is focused above the ribbon 16. The camera is adapted to take a motion picture of the ascent of the jumper and automatically records the height of his jump. The camera is equipped with a time delay switch which, after a specified interval after activation, deactivates the camera.

In the embodiments illustrated in FIGS. 7 and 8, it is preferred that brackets 54 and 56 be level with the ground and aligned with each other. Thus, in one preferred embodiment, bracket 54 (and/or, optionally, bracket 56) is supplied with a level 78.

Any of the commercially available levels well known to those skilled in the art may be used as level 78.

Figure 9:
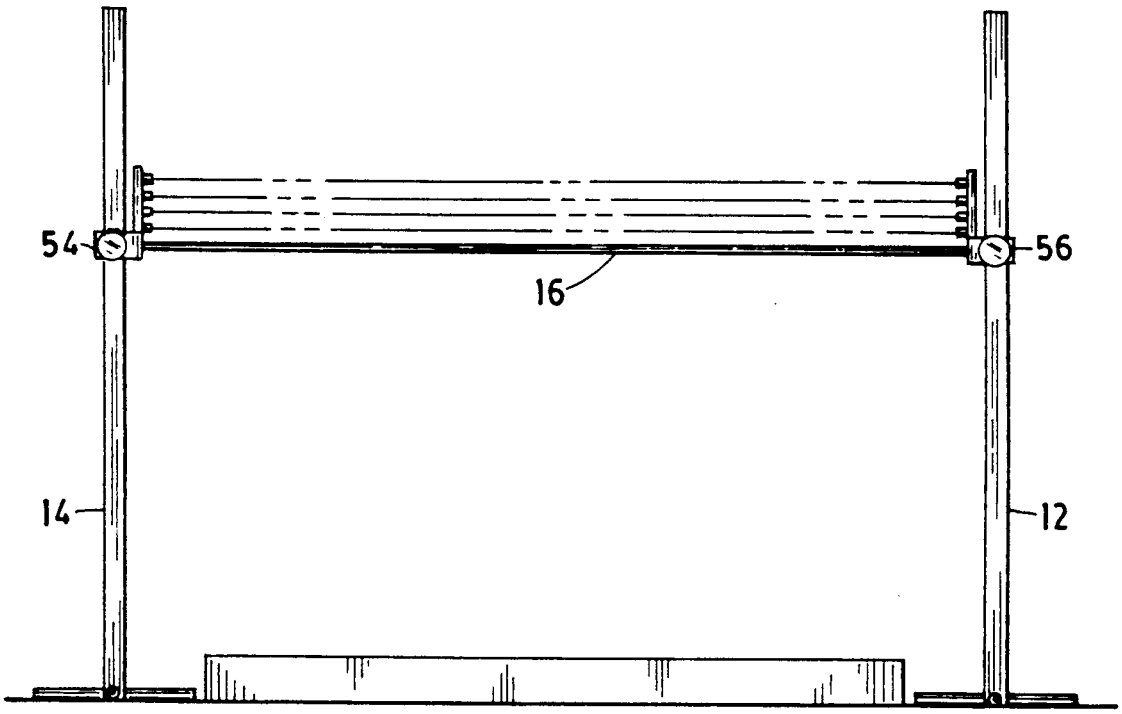
FIG. 9 is a view of a hurdle comprised of an embodiment of the invention which utilizes the brackets shown in FIGS. 7 and 8.

FIG. 9 illustrates one preferred embodiment of the invention utilizing the brackets 54 and 56 of FIGS. 7 and 8.

In one embodiment, not shown, where applicant's assembly is used for pole vaulting competitions, standards 12 and 14 are pivotally attached to each of their respective bases. After the jumper has disconnected ribbon 16 from one or both of the brackets, the standards are simultaneously pivoted towards the ground, the ribbon 16 is reconnected to the bracket from which it was disconnected, and the standards are then simultaneously swung back into the vertical position and thereafter held in the vertical position by a locking detente. In another embodiment, not shown, each of standards 12 and 14 contain means intermediate their proximal and distal ends for pivoting a top part of the standard towards the ground. In another embodiment, the mechanism disclosed in U.S. Pat. No. 3,222,064 of Langton may be used to move the standard towards the ground so the ribbon 16 may be readily reattached.

It is to be understood that the aforementioned description is illustrative only and that changes can be made in the apparatus, the ingredients and their proportions, and in the sequence of combinations and process steps as well as in other aspects of the invention discussed herein without departing from the scope of the invention as defined in the claims.

Thus, by way of illustration, the color, texture, weaving pattern, printed or woven markings, and/or trademarks on the highjump ribbon 16 may be varied or altered, as long as the ribbon produced retains only a limited reversible elasticity. This limited reversible elasticity, on the order of less than about 4 percent, prevents a too forceful "rebound" of the ribbon upon disengagement of one or both of the "VELCRO" closures from the brackets, and thus minimizes the chance of injury to the jumper.

Thus, for example, the "VELCRO" material on the brackets 18 and/or 20, and/or on ribbon 16, may be fastened by any feasible manner such as, e.g., sewing, clamping, glueing, bonding, etc.

I claim:

1. A high jump ribbon assembly which is comprised of a fabric ribbon, and at least two brackets, wherein:

(a) said fabric ribbon comprises a textile base material and, attached to at least two separate portions of said textile base material, two separate portions of fibrous fastener fabric, wherein:

1. said textile base material has a width of from about 1 to about 3 centimeters and a thickness of from about 0.5 to about 2 millimeters;
2. each of said portions of fibrous fastener fabric has a length of from about 2 to about 7 inches;
3. each of said portions of fibrous fastener fabric has a width of from about 1 to about 3 centimeters;
4. said fabric ribbon is comprised of at least two different textile materials;

(b) each of said brackets has attached thereto at least two separate pieces of complementary fibrous fastener fabric, wherein one of said pieces is loop fibrous fastener fabric, and the other of said pieces is complementary hook fibrous fastener fabric; and (c) each of said brackets comprises means for adjustably securing said bracket to a standard.

2. The high jump ribbon assembly as recited in claim 1, wherein said textile base material consists essentially of cotton.

3. The high jump ribbon assembly as recited in claim 1, wherein said textile base material consists essentially of nylon.

4. The high jump ribbon assembly as recited in claim 3, wherein said ribbon has a reversible elasticity of less than about 4 percent.

5. The high jump ribbon assembly as recited in claim 4, wherein said means for attaching said bracket to a standard is comprised of a spring-steel pressure plate.

6. The high jump ribbon assembly as recited in claim 4, wherein said means for attaching said bracket to a standard is comprised of a spring-loaded pressure plate.

7. The high jump ribbon assembly as recited in claim 1, wherein at least one of said brackets is comprised of a light source.

8. The high jump ribbon assembly as recited in claim 7, wherein at least one of said brackets is comprised of a multiplicity of light sources.

9. The high jump assembly as recited in claim 8, wherein the distance between adjacent light sources on said bracket is from about 0.5 to about 2.0 inches.

10. The high jump assembly as recited in claim 9, wherein at least one of said brackets is comprised of an optical sensor.

11. The high jump assembly as recited in claim 10, wherein at least one of said brackets is comprised of a multiplicity of optical sensors.

12. The high jump assembly as recited in claim 11, wherein the distance between adjacent optical sensors on said bracket is from about 0.5 to about 2.0 inches.

13. The high jump assembly as recited in claim 4, wherein said textile base material has a width of from about 1.5 to about 2.5 centimeters.

14. The high jump assembly as recited in claim 13, wherein said textile base material has a width of about 2.0 centimeters.

15. The high jump assembly as recited in claim 1, wherein at least one of said brackets has a substantially rectangular cross-section.

16. The high jum assembly as recited in claim 15, wherein at least one of said brackets is comprised of a light source.

17. The high jump ribbon assembly as recited in claim 16, wherein at least one of said brackets is comprised of a multiplicity of light sources.

18. The high jump assembly as recited in claim 17, wherein the distance between adjacent light sources on said bracket is from about 0.5 to about 2.0 inches.

19. The high jump assembly as recited in claim 18, wherein at least one of said brackets is comprised of an optical sensor.

20. The high jump assembly as recited in claim 19, wherein at least one of said brackets is comprised of a multiplicity of optical sensors.

* * * * *